United States Patent [19]

Joyce et al.

[11] Patent Number: 4,798,652

[45] Date of Patent: Jan. 17, 1989

[54] PEROXIDE BLEACHING OF MECHANICAL PULPS

[76] Inventors: Peter Joyce, 5344-6th Avenue, South Delta, British Columbia, Canada, V4M 1L5; David M. Mackie, 686 Crystal Court, North Vancouver, British Columbia, Canada, V7R 2B5

[21] Appl. No.: 110,179

[22] Filed: Oct. 19, 1987

[51] Int. Cl.[4] ..... D21C 3/00

[52] U.S. Cl. ..... 162/60; 162/78; 162/90

[58] Field of Search ..... 162/78, 17, 90, 60

[56] References Cited

U.S. PATENT DOCUMENTS 4,207,140 6/1980 Lindahl ..... 162/78 X

FOREIGN PATENT DOCUMENTS 686115 5/1964 Canada .

*Primary Examiner*—Peter Chin
*Assistant Examiner*—Thi Dang
*Attorney, Agent, or Firm*—C. A. Rowley

[57] ABSTRACT

A process for peroxide bleaching of mechanical pulps by washing the pulp to remove substantially all of the heavy metal ions from the pulp, mixing hydrogen peroxide in an amount of at least about 1½% based on the dry weight of the pulp with the washed pulp to uniformly disperse the hydrogen peroxide throughout the pulp followed by mixing an aqueous solution of sodium hydroxide with the pulp containing hydrogen peroxide to uniformly distribute the sodium hydroxide throughout the pulp and to react the sodium hydroxide with the peroxide to produce perhydroxyl ions in situ in the pulp and then reacting the perhydroxyl ions with the pulp to increase the brightness of the pulp and provide a residual peroxide of at least 35% of the peroxide added. This system provides a significant increase in residual brightening chemical in the residual liquor separated from the brightened pulp. In a preferred process to utilize this residual brightening chemicals, the washed pulp is divided into two portions and the hydrogen peroxide is added to one portion as above described, following reaction of the perhydroxyl ions with the pulp of the one portion the so brightened pulp portion is separated from a residual liquor containing residual brightening chemnicals. This residual liquor containing the residual brightening chemicals is uniformly mixed with the second portion of the pulp followed by dispersion of caustic through the second portion to cause reaction of the residual brightening chemicals with the second portion of the pulp to brighten the second portion of the pulp.

19 Claims, 2 Drawing Sheets

PEROXIDE BLEACHING OF MECHANICAL PULPS

FIELD OF THE INVENTION

Present invention relates to the brightening of mechanical pulps, more particularly the present invention relates to hydrogen peroxide brightening of mechanical pulps by in situ formation of the perhydroxyl ion to provide a brightened pulp and a peroxide residual of at least 35% of the peroxide added and to a process wherein residual from treatment of a first pulp is used to treat a second pulp.

BACKGROUND OF THE PRESENT INVENTION

In conventional peroxide brightening of mechanical pulp a brightening liquor containing perhydroxyl ions is first formed by reacting hydrogen peroxide with sodium hydroxide to form the perhydroxyl ion in water. This liquor containing the brightening chemical (perhydroxyl ion) is then added to the pulp and functions to oxidize color compounds in the pulp to colorless form thereby increasing the pulp whiteness or brightness.

The ratio of peroxide to caustic (sodium hydroxide) in the brightening solution must be optimized for each pulp. Too little caustic would leave some of the hydrogen peroxide in unreacted form while too much caustic causes the perhydroxyl ions to decompose thus wasting some of the perhydroxyl ion and further could result in alkali darkening of the pulp. Compounds are produced during the pulp brightening that tend to utilize the sodium hydroxide so that the optimum caustic to peroxide ratio varies depending on species and quality of the wood being brightened.

Generally, the magnesium sulfite and sodium silicate are incorporated in the brightening liquor, i.e. liquor containing the perhydroxyl ions to protect the perhydroxyl ions from decomposition until it reacts with the pulp, i.e. in storage and until the actual brightening reaction takes place in the pulp.

In a typical composition, magnesium sulfate and sodium silicate are first added in amounts related to the bone dry weight of the pulp being brightened. Peroxide addition is keyed to obtain the desired degree of pulp brightness thus is based on desired degree pulp brightness and on amount of pulp while the sodium hydroxide usage is dependent on the peroxide used (pulp brightness desired) and obviously as above indicated on the species being treated.

Because of the reactivity of the perhydroxyl ion the brightening solution has to be made by specific sequential additions of the individual chemicals. Normally, a cascading system is used wherein magnesium sulfate is first added to water and then sodium silicate is added and intimately mixed followed by the addition of caustic and finally by the addition of hydrogen peroxide, the resulting liquor then is stored in a bleach liquor storage tank until used.

This process obviously results in some decomposition of the reactive perhydroxyl ions in storage and requires a significant amount of process equipment such as tanks, pumps, mixers, etc for each of the separate ingredients. Also, the magnesium and silicate present in the mixture form complexes which precipitate and sometimes result in scaling and plugging problems.

It will be apparent that if there is a rapid change in wood quality it is not a simple matter of varying the brightening solution usage on wood, rather it is necessary to change the whole composition of the brightening solution. Clearly, when such changes are made they are not reflected in the system until the previously made brightening solution has been used thereby causing an inherent time delay when a change in the brightening composition for the pulp is implemented.

Canadian Pat. No. 686,115 issued May 12, 1964 to Guard describes a system of bleaching wood pulp wherein the wood is first treated wtih a chelating agent to remove or deactivate catalytic ions followed by thickening to typically about 14%–15%. Initially the resultant thickened pulp is treated with hydrogen peroxide followed by the addition of a buffered sodium hydroxide, i.e. sodium hydroxide and silicate solution, thereby silicates are incorporated into the system. This two stage bleaching technique is claimed to improved the brightness relative to conventional process, however, it is believed in this case the improvement in brightness was probably due to preliminary treatment with a chelate followed by thickening with possibly some improvement being attributed to the two stage process.

When using hydrogen peroxide as a bleaching agent it has normally been found that to obtain a given degree of brightness for a given pulp requires a specific percentage of hydrogen peroxide and that variations in the process usually do not materially change the total application of peroxide to pulp to obtain the given degree of brightness.

It is also kwown that there is residual peroxide in the bleaching liquor accompanying the bleached pulp from the bleaching tower, however, this residual generally does not exceed about 30% of the added peroxide thereby rendering the recovery of this residual chemical unjustifiable.

BRIEF DESCRIPTION OF THE PRESENT INVENTION

It is an object of the present invention to provide a more versatile and efficient system of bleaching mechanical pulp using hydrogen peroxide by forming the perhydroxyl ion in situ in the pulp slurry to brighten the pulp, separating residual chemical from the brightened pulp and using the residual to brighten another pulp.

Broadly, the present invention relates to a process for peroxide bleaching of mechanical pulps comprising washing said pulp to reduce the reactive components including heavy metal ions in said pulp to a level so that significant quantities of hydrogen peroxide is not consumed when peroxide is added to the pulp, mixing hydrogen peroxide and an aqueous solution of peroxide compatable chelating agent, if required, with said washed pulp to apply at least 1½% hydrogen peroxide based on the oven dry weight of the pulp to uniformly disperse said hydrogen peroxide throughout the pulp, mixing an aqueous solution of caustic (sodium hydroxide) into said pulp containing the hydrogen peroxide to disperse same uniformly therethrough and reacting over a period of at least 45 minutes said sodium hydroxide with said peroxide to produce perhydroxyl ions in situ in said pulp and reacting said perhydroxyl ions so formed with the pulp to brighten the pulp and provide a residual peroxide of at least 35% based on the peroxide added (and in any event at least 20% more than that available if the same pulp were treated in a conventional one stage chemical addition process wherein the peroxide and caustic are added together in a solution) separating said residual from the brightened pulp and using the residual to treat a second pulp.

As indicated the above process increases the residual bleaching chemical relative to the amount that would normally be found when a conventional bleaching operation is used. In a preferred process specially adapted to use this residual, the washed pulp is first divided into two portions with the first portion being treated as above described by reacting perhydroxyl ions formed in situ in the pulp followed by separating a residual liquor containing residual brightening chemical from the brighten pulp, uniformly mixing the said residual liquor with the second portion of the pulp to distribute said chemicals throughout said second portion, adjusting the pH of the second portion of the pulp with said chemical distributed throughout thereby to brighten said second portion.

This increased residual may also be used for example, in deinking systems in mills that incorporate deinking systems or in any other suitable process requiring peroxide wherein the residual chemical is compatible, for example, to upgrade stone groundwood.

The residual featuring a second pulp may also be separated and used to treat a third pulp, for example, when the brightness of the third pulp need not be raised to a high value.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

In describing the invention the peroxide has been described as hydrogen peroxide and the percentages given are based on hydrogen peroxide as this is the preferred source of peroxide. It will be apparent that other suitable peroxides are also contemplated and that if other peroxides are used the amounts used will require appropriate adjustment to provide the requirement amount of active chemical.

Figure 1:
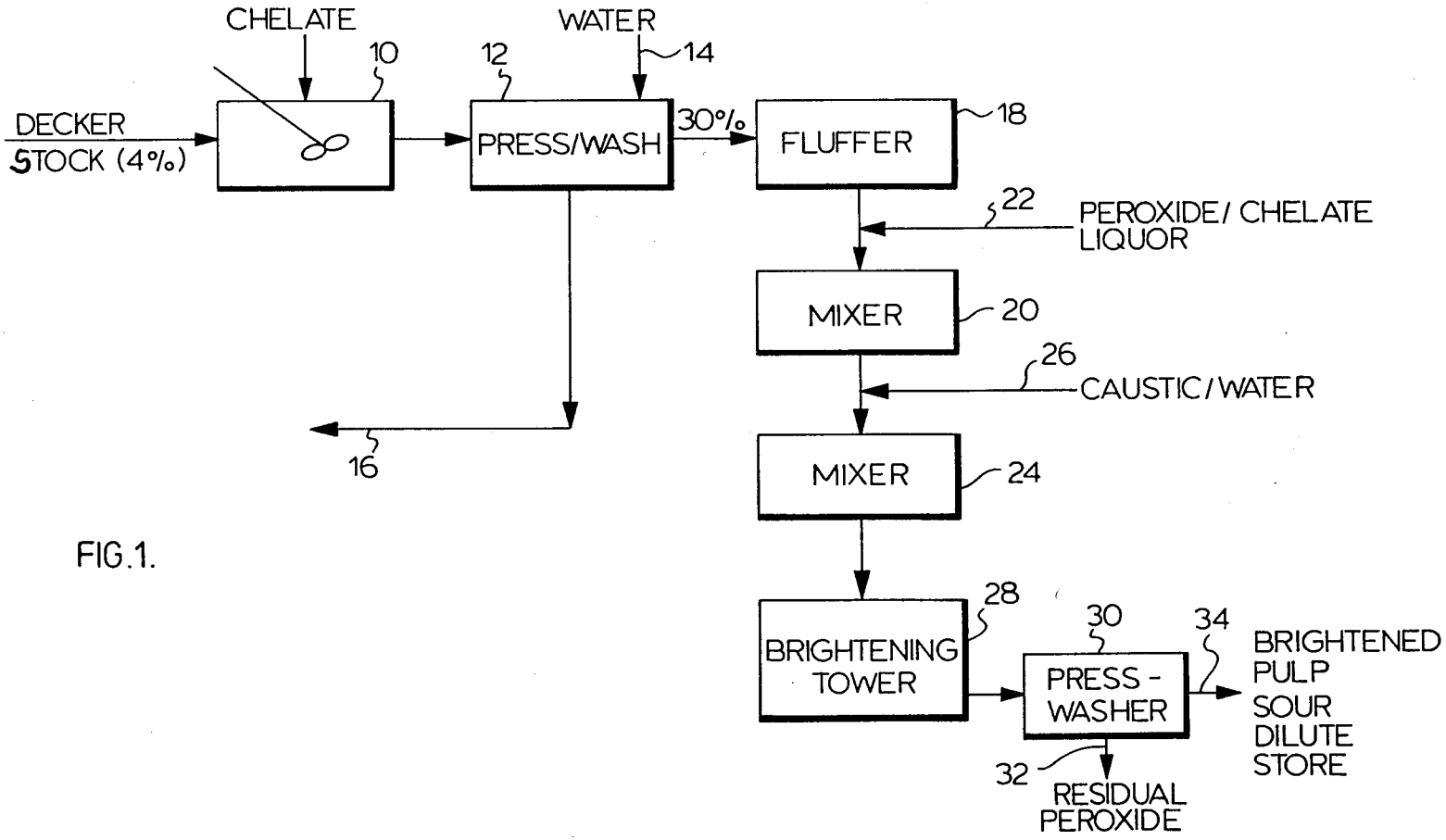
FIG. 1 is a schematic representation of a brightening process incorporating the present invention.

As shown schematically in FIG. 1 a pulp slurry at low consistency passes from a decker or the like (not shown) into a mixer 10 wherein a suitable chemical such as a chelate is added to the pulp stock. Generally, the pulp stock at this stage will be at a consistency of less than 5% preferably 1% to 3%. The chelating agent preferably will be a relatively powerful agent effective to complex and solubilize reactive heavy metals in the pulp, for example, diethylene triamine penta acetic acid (DTPA) or the chelate discussed in EPC patent application publication No. 0186990 published 10.12.85 or other similar or suitable compounds or mixtures thereof. The pulp is then transported into a washer 12 wherein the pulp is washed to remove the solubilized heavy metals and heavy metal complexes as well as soluble organic extractives. Preferably, washing will be through a double or twin wire press washer in which a final washing stage is a displacement washing stage. Generally, the pulp leaves the washer 12 at a consistency of at least 20% and preferably over 30% and contains a significantly reduced metal ion content.

Fresh water enters the press washer 12 as indicated by the arrow 14 and displaces effluent (liquor and contaminants from the pulps) as indicated by the arrow 16.

The washed pulp at high consistency then passes to a fluffer 18 (optional) and into a mixer 20 where the washed pulp is mixed with a hydrogen peroxide liquor preferrably, in fact essentially, except in exceptional circumstances containing a protective chelate entering as indicated by the arrow 22. In the illustrated arrangement, the hydrogen peroxide is shown as entering between the fluffer and mixer 20. It can be introduced directly into the mixer 20 if desired. The pH of the pulp containing added proxide and chelate solution will be below about 7 to minimize reactions of the peroxide with the pulp.

It is important that the mixer 20 mix the pulp and hydrogen peroxide (plus chelate) liquor to uniformly distribute the hydrogen peroxide throughout the pulp.

After the hydrogen peroxide and pulp have been uniformly mixed in the mixer 20, the so formed mixture is then fed to a second mixer 24 where caustic is added as indicated by the line 26. The caustic is shown as added before the mixer 24, but it could also be added directly to the mixer it being important that the mixer 24 uniformly distribute the caustic throughout the pulp, so that, the caustic can react with the peroxide in situ in the pulp and form the perhydroxyl ions in situ. Generally the pH after caustic addition will be above about 8. The pulp containing caustic and peroxide uniformly distributed throughout is passed to a brightening tower 28 wherein reaction of caustic (sodium hydroxide) with the peroxide (hydrogen peroxide) continues to form perhydroxyl ions and the perhydroxyl ions so formed in situ in the pulp react with the pulp to brighten same.

It is important that the peroxide solution be added to and be dispersed uniformly through the pulp before the caustic is added, if the full benefit of the inventions are to be obtained. If the caustic is added too soon after or at the same time as the peroxide, the caustic may well react with the pulp or with the perhydroxyl ions being formed in quantities sufficient to lose some of the benefit of the invention. If the caustic is added before the peroxide it is likely to react with and darken the pulp. Thus while separate mixers are used in the various embodiments described herein it will be apparent that both peroxide and caustic may be added in an appropriate single mixer provided the above described sequences are effected to ensure the benefits of the invention are attained.

After a suitable time in the brightening tower 28 the brighten pulp is withdrawn and passed to a suitable washer such as the press washer indicated at 30 to separate residual liquor containing residual peroxide from the pulp as indicated at 32. The brighten and washed pulp exits the washer 30 in line 34 and any remaining bleaching chemical is soured and the brightened pulp delivered to pulp storage.

The washing of the fresh pulp in the press washer 12 is to produce a pulp that is relatively free of peroxide destroying chemicals. The peroxide solution, i.e. hydrogen peroxide in water is, as above indicated, preferably and normally protected by a suitable protective agent such as a chelating agent that is compatible with the peroxide and does not combine therewith to reduce the effectiveness of the peroxide in the process. This protecting agent is added to the peroxide before it is added to and uniformly distributed throughout the pulp slurry. Obviously, if this pretreatment stage (addition of peroxide) is to be efficiently carried out there must be few if any peroxide destroying components available in the pulp to react with the peroxide and render same useless for brightening. The protecting agent (chelate) in the peroxide protects same and increases the amount of these impurities that may be tolerated. If the pulp is substantially free of such peroxide destroying chemicals and mixing is carried out in nonreactive atmosphere, i.e. in equipment made of suitable materials that do not contribute to the deterioration of the hydrogen peroxide, the use of a protecting chelating agent with the hydrogen peroxide may not be necessary. It will be apparent that the later circumstances are seldom if ever available and in any event as a safety measure normal practice will be to include a suitable protecting chelating agent in the hydrogen peroxide solution.

It is believed that the efficiency of the process of the present invention is dependent on maximum removal of contaminants in the press washing stage, proper distribution of the hydrogen peroxide in the pulp slurry and rapid and proper dispersion of the sodium hydroxide ions through the peroxide treated pulp slurry.

The quantities of peroxide and caustic used for brightening when following the teaching of the present invention will normally be essentialy the same as with prior art peroxide brightening process to obtain a specific degree of brightness and thus will depend on the brightening required (peroxide) and on the specific pulp being treated (caustic). In any event to obtain the required increase in and/or an amount of active chemical in the residual liquor after bleaching for use in accordance with the present invention the minimum amount of peroxide will be about 1½% peroxide based on hydrogen peroxide and oven dry weight of the pulp. Obviously there must be sufficient caustic to cause the peroxide to be converted to perhydroxyl ions with an excess to neutralize acids formed in the brightening operation. Too much caustic is detrimental to the process as is too little caustic, the precise amount being determined for the pulp being treated. Generally when sodium hydroxide is the caustic this will be at least 50% by weight of the hydrogen peroxide added.

With such a system of in situ perhydroxal ion formation a residual containing at least 35% and normally at least about 50% of the hydrogen peroxide applied is available after the normal brightening reaction. The residual chemical from the in situ perhydroxal formation method normally contains at least in an amount of hydrogen peroxide 20% higher than the amount of hydrogen peroxide available from a residual liquor obtained by the conventional one stage (or single addition) peroxide brightening process wherein both peroxide and caustic are added simultaneously. Furthermore, the peroxide in this residual formed in situ is relatively stable at temperatures up to about 80° to 90° C. and can be stored and used to treat other material (pulp).

In a preliminary trial using 3% hydrogen peroxide brightening on chemithermomechanical pulp from MacMillan Bloedel's Powell River pulp mill, samples were washed with a chelating agent to remove metals and were treated in the conventional single addition manner and by the formation of the perhydroxyl ion in situ in the pulp in accordance with the present invention. The final brightnesses of the two treated pulps were essentially the same (in one test 73.2 and 73.1 respectively points Elrepho brightness), however, the residual reactive bleaching chemical (peroxide) after the brightening step was 50% higher using the in situ method as compared to the conventional method, i.e. following the conventional method reactive chemical equivalent to about 40% of the starting peroxide was in the residual and following the in situ method reactive chemical equivalent to about 60% of the starting peroxide was available in the residual.

EXAMPLE

Wash Stage: 25 b.d. g of hembal CTMP (0.8% sulfonation) was washed to remove metals and soluble contaminants by diluting the pulp to 1% consistency with deionized (DI) water and treating this slurry with 0.14% chelate diethlyene triamine penta acetic acid (DTPA). Chelate percentage based on weight of bone dry pulp. The dilute slurry was kept at 60° C. for 10 minutes to allow complete chelation to take place and then 97% of the soluble contaminants were removed by thickening to approximately 30% consistency.

Hydrogen Peroxide Addition: The thickened pulp was diluted to 20% consistency with deionized water, heated to 60° C. and then reacted with an aqueous solution containing 3% hydrogen peroxide and 0.6% Dow chelate XU-11082.00L (see European patent application publication No. 0186990 published 10.12.85) to give a pulp slurry having a consistency of 17% w/w. Peroxide and chelate percentages are based on the amount of pulp fiber (bone dry basis) present. Adequate mixing was carried out to ensure excellent dispersion of the peroxide molecules through the pulp slurry.

Sodium Hydroxide: Sodium hydroxide (2.1% based on b.d. pulp) was dissolved in sufficient deionized water at 60° C. so that when added to the pulp containing the peroxide the resultant consistency is 8% w/w. The alkaline solution is mixed to ensure efficient contact between the peroxide and the hydroxide molecules in the slurry.

The resultant mixture was allowed to stand at 60° C. for 90 minutes for pulp brightening.

Pulp samples were then taken, the residual peroxide content, and the pulp brightness after souring to pH 5.0 with sulfurous acid, were measured.

| Results | Brightness points | Residual $H_2O_2$ % of Starting |
|---|---|---|
| Optimized Conventional Process Using 3% $H_2O_2$ | 73.7 | 39.7 |
| In Situ Process Using 3% $H_2O_2$ | 73.2 | 59.0 |

It will be apparent that the quantity of residual reactive bleaching chemical (hydrogen peroxide) in the residual liquor separate from the brightened pulp is now very significant, it is relatively stable and economically recoverable for brightening further pulp or for any other useful purpose.

The consistency of the pulp containing peroxide and hydroxide was deliberately lowered to the relatively low value of 8% to test the invention under adverse conditions (and it operated effectively), but normally the consistency at this point, i.e. in the tower 28, will be in the range of about 22% to 28%.

Figure 2:
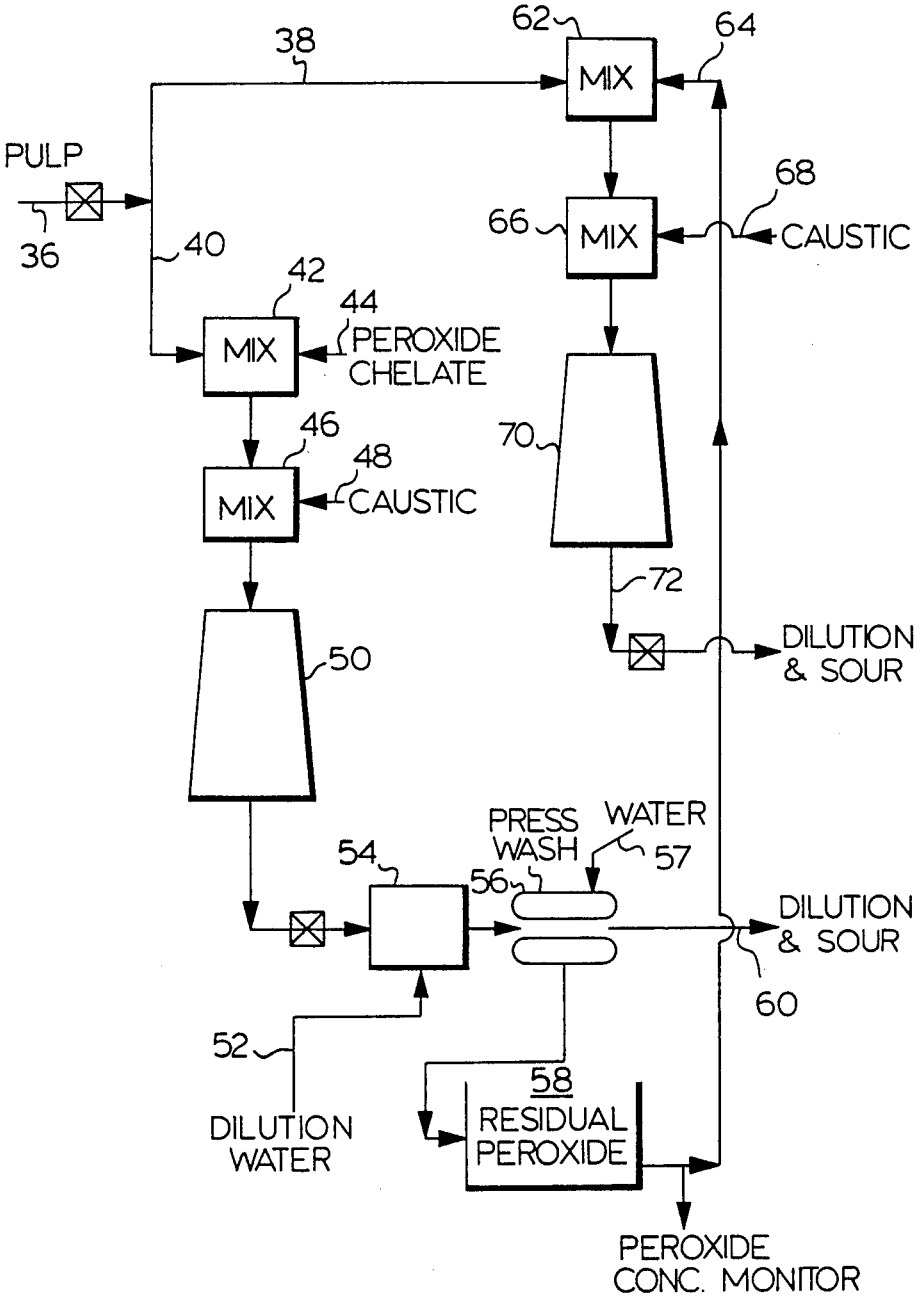
FIG. 2 is a schematic illustration of a process using recycle residual perhydroxyl ions for brightening a portion of the pulp.

The process schematically illustrated in FIG. 2 illustrates a preferred way to recover and use the residual reactive bleaching chemical in the residual separate from the pulp. In this system washed pulp from said pulp washer 12 of FIG. 1 is conveyed by line 36 into the system shown in FIG. 2.

The pulp from line 36 is divided into two portions, one in line 38 and the other in line 40. As above indicated about 50% of the peroxide is left in the residual liquor from the bleaching operation and therefore it is preferred to divide the flow into one-third in say line 38 and two-thirds of the pulp flow in line 40.

In the illustrated arrangement, the pulp in line 40 (two-thirds of the pulp) is directed to a mixer generally indicated at 42 wherein hydrogen peroxide is mixed with the pulp to uniformly distribute the hydrogen peroxide throughout the pulp. Arrow 44 indicates the introduction of the hydrogen peroxide. In some cases, depending on the condition of the pulp and the particular mixing equipment and bleaching equipment used, it normally will, as above indicated, be necessary to protect the hydrogen peroxide from deterioration by the addition of certain protectors particularly chelates to tie up and heavy metal that may be contacted by the hydrogen peroxide.

The mixture of pulp and peroxide is directed from mixer 42 to a second mixer 46 wherein caustic is introduced as indicated by line 48 and the caustic uniformly mixed with the mixture of pulp and hydrogen peroxide so that there is a uniform distribution of caustic throughout the pulp peroxide mixture.

The caustic (NaOH) reacts with the peroxide to form as above described the perhydroxyl ion which reacts with the pulp to brighten same. The mixture formed in mixer 46 is carried into the bleaching vessel 50 wherein the brightening of the pulp is completed.

Preferably, the brightened pulp from the bleaching vessel 50 is first diluted as indicated by the addition of dilution water via arrow 52 into the mixer 54 and the diluted brightened pulp is then carried to a press washer 56 wherein the residual brightening solution containing residual reactive bleaching chemical (peroxide) is washed from the pulp and is collected in a suitable tank as indicated at 58. The brightened pulp is then diluted and soured in the conventional manner and passed on to the next stage and storage as indicated by the arrow 60.

The one-third of the pulp carried in line 38 is moved into a mixer 62 wherein it is mixed with the residual liquor containing the residual bleaching chemical (peroxide) carried via line 64 from the residual peroxide tank 58. The mixer 62 thoroughly mixes the residual liquor from line 64 with the pulp from line 38 to uniformly distribute the bleaching chemical containing peroxide uniformly throughout the pulp.

The homogeneous mixture of pulp and residual liquor from mixer 62 is, in the illustrated arrangement, carried to a mixer 66 wherein caustic is added as indicated by line 68 and mixed with the mixture of residual liquor and pulp to adjust the pH to the required level for conversion of peroxide in the residual bleaching chemical to perhydroxyl ions and the perhydroxyl ions to react with the pulp (pH will normally be in the range of 9–11).

The pH adjusted mixture of pulp and residual liquor passes from mixer 62 into a second bleaching vessel 70 wherein the brightening of the pulp from line 38 is completed. The brightened pulp leaves the system (vessel 70) via line 72 and is diluted and soured in the conventional manner.

The flows in line 60 and 72 have slightly different brightnesses and may be mixed in suitable proportions to obtain a desired degree of brightness of the resultant pulp, or all of the flow from line 60 may be blended with the flow from line 72 as required.

As is well known, the consistency during bleaching has an effect on the final brightness on the pulp being produced. In a specific example the pulp enters the system in line 36 at a consistency of about 30% and is fed to the mixers 42 and 62 at 30%. However, the addition of the aqueous solutions of peroxide and caustic in the mixers 42 and 46 respectively will dilute the stock from line 40 down to about 26% consistency in the tank 50. This brightened pulp is then further diluted in the mixer 54 and the residual liquor is washed from the pulp in the washer 56 by the addition of fresh water as indicated by the arrow 57 so that the residual peroxide liquor collected in the tank 58 is significantly less concentrated than the hydrogen peroxide added in line 44.

Nevertheless, this more dilute residual liquor containing the perhydroxyl ions is added to pulp in line 38 and the mixer 62 thereby to dilute the pulp from line 38 which is further diluted by the addition of caustic in mixer 66 so that the concentration in bleaching vessel 70 is significantly lower than the concentration in the bleaching vessel 50 (generally, less than half say between about 6% and 12% consistency). This lower consistency and the fact that the residual bleaching chemical is not quite as effective as fresh chemical may result in a slightly lower degree of bleaching, i.e. the brightness may be slightly less in the pulp leaving vessel 70 than the pulp leaving vessel 50 (assuming there is same percent peroxide utilized on each pulp flow) partially because bleaching is at a lower consistency and partially because the perhydroxyl ions in the residual liquor are not quite as effective as those formed in situ in the pulp. Obviously, this can be remedied at least to a degree by increasing the percent peroxide (residual liquor) added to flow 38 to compensate for the lower consistency, for example, by adjusting the division of pulp in line 38 and 40 so that slightly more than two-thirds of the flow is in line 40 and less than one-third of the flow is in line 38 and again assuming about a 50% residual, the percent peroxide to pulp will be increased in the material flowing along line 38.

It will be apparent that the in situ method of brightening by forming the perhydroxyl ions in situ in the pulp permits reducing the consistency of the pulp during the bleaching or brightening stage without reducing bleaching efficiently nearly to the extent it would be reduced if a conventional bleaching operation were being carried out at such low consistency.

Table I shows the results obtained by following the method illustrated in FIG. 2 and compares the standard one stage addition process with the brightening for different time periods and pulp temperatures of the pulp using fresh peroxide (pulp I) and that obtained using residual peroxide (pulp II).

TABLE I

| | Pulp Chemithermomechanical Pulp | | | | |
|---|---|---|---|---|---|
| Method | Brightening Time, min | Brightness points | | $H_2O_2$ in Resid % $H_2O_2$ Added | |
| Temperature | | 60° C. | 80° C. | 60° C. | 80° C. |
| Standard Process | 90 | 74.2 | | 32.67 | |
| Fresh $H_2O_2$ | 30 | 70.4 | 72.8 | 56 | 48 |
| Pulp I | 60 | 72.0 | 75.0 | 55 | 36 |
| Two Stage | 90 | 72.9 | 74.0 | 54 | 44 |
| Process | 120 | 73.9 | 75.0 | 54 | — |
| Use of Residual | | | | | |
| $H_2O_2$ | 30 | 67.3 | 71.5 | 57 | 34 |

TABLE I-continued

| Method | Pulp Chemithermomechanical Pulp | | | | |
|---|---|---|---|---|---|
| | Brightening Time, min | Brightness points | | $H_2O_2$ in Resid % $H_2O_2$ Added | |
| Pulp II | 60 | 70.0 | 73.1 | 49 | — |
| Two Stage | 90 | 70.9 | 73.1 | 39 | 33 |
| Process | 120 | 72.2 | 72.9 | 40 | 28 |

It will be apparent that the residual chemical remaining after treatment of pulp II is still substantial when following the present invention, e.g. assuming 5% peroxide addition to pulp I with a 0.55% residual and a 50% residual from pulp II the residual chemical available from pulp II is equal to $5\times0.55\times0.5=1.375\%$ of pulp I. This residual is a significant amount that may justify a further separation of residual from pulp II by the incorporation of a press or press wash similar to that employed for pulp I and indicated at 56 in the line 72 to separate the residual from pulp II before it is soured.

The residual chemical separated from pulp II is dilute and may be used for bleaching other pulps but normally will only be recovered and used to bleach pulps where the increase in brightness (final brightness) is relatively low but in many mills this will be significant as it may, for example, be used in place of hydrosulfite bleaching or brightening.

It will be apparent that it is preferred to use the residual in the in situ method, i.e. to treat pulp by first adding the residual and then the caustic as above described, but in some instances the residual may be treated in the conventional manner with the addition of caustic and suitable stabilizers and then applied to a pulp for brightening the pulp.

The process lends itself well to bleaching of wood pulp and had been described accordingly, but it may well find use with other cellulosic materials.

Having described the invention, modifications will be evident to those skilled in the art without departing from the spirit of the invention as defined in the appended claims.

We claim:

1. A process for peroxide bleaching of mechanical pulp comprising washing a first and second pulp to reduce the amount of heavy metal ions in said first and second pulp to provide a first and second washed pulp, mixing peroxide in an amount of the equivalent of at least 1½% peroxide as hydrogen peroxide based on the oven dry weight of said pulp with said first washed pulp to disperse said peroxide uniformly throughout said first washed pulp while maintaining the pH of said peroxide less than 7 to form a mixture of said first pulp and said peroxide mixing an aqueous solution of caustic with said mixture of said first pulp and said peroxide to uniformly mix said caustic into said mixture, said caustic being present in an amount of at least 50% by weight of the amount of peroxide added based on NaOH as the caustic, reacting said caustic with said peroxide to produce perhydroxyl ions in situ in said first pulp and reacting said perhydroxyl ions with said first pulp to provide a brightened first pulp brightened to the desired degree substantially solely by said perhydroxyl ions produced in situ in said first pulp and a residual liquor containing bleaching chemical equivalent to at least 35% of said peroxide added, separating said residual liquor from said brightened first pulp and utilizing said separated residual liquor to brighten said second pulp to the desired degree.

2. A process as defined in claim 1 wherein said peroxide is hydrogen peroxide.

3. A process as defined in claim 2 wherein said caustic is sodium hydroxide.

4. A process as defined in claim 1 wherein said second pulp is brightened by thoroughly mixing said separated residual liquor with said second pulp to provide a second mixture and thereafter adding caustic to said second mixture of said second pulp and said separated residual liquor to form perhydroxyl ions in situ in said second pulp and reacting said perhydroxyl ions formed in situ in said second pulp with said second pulp.

5. A process as defined in claim 1 wherein said pulp and said second pulp are washed with a suitable chelating agent to remove said heavy metal ions before addition of peroxide.

6. A process as defined in claim 1 wherein said peroxide mixed with said first washed pulp is protected by a suitable chelating agent.

7. A process as defined in claim 5 wherein said peroxide mixed with said first washed pulp is protected by a suitable chelating agent.

8. A process as defined in claim 3 wherein said peroxide mixed with said first washed pulp is protected by a suitable chelating agent.

9. A process as defined in claim 1 wherein said second pulp is brightened by a process consisting essentially of thoroughly mixing said separated residual liquor with said second pulp to provide a second mixture and thereafter adding caustic to said second mixture of said second pulp and said separated residual liquor to form perhydroxyl ions in situ in said second pulp and reacting said perhydroxyl ions formed in situ in said second pulp with said second pulp.

10. A process as defined in claim 5 wherein said second pulp is brightened by a process consisting essentially of thoroughly mixing said separated residual liquor with said second pulp to provide a second mixture and thereafter adding caustic to said second mixture of said second pulp and said separated residual liquor to form perhydroxyl ions in situ in said second pulp and reacting said perhydroxyl ions formed in situ in said second pulp with said second pulp.

11. A process as defined in claim 6 wherein said second pulp is brightened by a process consisting essentially of thoroughly mixing said separated residual liquor with said second pulp to provide a second mixture and thereafter adding caustic to said second mixture of said second pulp and said separated residual liquor to form perhydroxyl ions in situ in said second pulp and reacting said perhydroxyl ions formed in situ in said second pulp with said second pulp.

12. A process as defined in claim 7 wherein said second pulp is brightend by a process consisting essentially of thoroughly mixing said separated residual liquor with said second pulp to provide a second mixture and thereafter adding caustic to said second mixture of said second pulp and said separated residual liquor to form perhydroxyl ions in situ in said second pulp and reacting said perhydroxyl ions formed in situ in said second pulp with said second pulp.

13. A process as defined in claim 3 wherein said second pulp is brightened by a process consisting essentially of thoroughly mixing said separated residual with said second pulp to provide a second mixture and thereafter adding causting to said second mixture of said second pulp and said separated residual to form perhydroxyl ions in situ in said second pulp and reacting said perhydroxyl ions formed in situ in said second pulp with said second pulp.

14. A process as defined in claim 9 wherein said peroxide is hydrogen peroxide.

15. A process as defined in claim 14 wherein said caustic is sodium hydroxide.

16. A process as defined in claim 13 wherein said pulp is washed with a suitable chelating agent to remove heavy metal ions.

17. A process as defined in claim 16 wherein said peroxide is mixed with said washed pulp is protected by a suitable chelating agent.

18. A method as defined in claim 13 wherein said peroxide mixed with said washed pulp is protected by a suitable chelating agent.

19. A method for providing a brightened pulp comprising dividing said pulp into a first portion and a second portion different from said first portion, treating said first portion with peroxide to form perhydroxyl ions in situ in said pulp and reacting said perhydroxyl ions with said pulp to provide a first brightened pulp brightened substantially solely by said perhydroxyl ions formed in situ in said first portion, separating a residual liquor containing reactive bleaching chemical from said first brightened pulp, brightening said second portion substantially solely by uniformly mixing said residual liquor with said second portion to form a mixture, mixing caustic with said mixture to adjust the pH of said mixture and form perhydroxyl ions in situ in said second portion from said reactive bleaching chemical in said residual liquor and brightening said second portion by reacting said perhydroxyl ions formed in situ in said second portion with said second portion of said pulp.

* * * * *